US005091677A

United States Patent [19]

Bleich et al.

[11] Patent Number: 5,091,677

[45] Date of Patent: Feb. 25, 1992

[54] LIGHTING CONTROL SYSTEM FOR PINBALL GAMES

[75] Inventors: Charles R. Bleich; Mark Coldebella; Lawrence E. DeMar, all of Chicago, Ill.

[73] Assignee: Williams Electronics Games, Inc., Chicago, Ill.

[21] Appl. No.: 653,305

[22] Filed: Feb. 11, 1991

[51] Int. Cl.[5] ..... H05B 41/36

[52] U.S. Cl. ..... 315/360; 315/315; 315/307; 315/362; 307/141; 362/811

[58] Field of Search ..... 315/360, 185 S, 323, 315/209 R, 200 A, 186, 315, 307, 362; 362/806, 811; 323/238, 271, 321; 307/141.4, 139, 141

[56] References Cited

U.S. PATENT DOCUMENTS 3,941,926 3/1976 Slobodzian ..... 340/335 X
3,961,365 6/1976 Payne ..... 340/335 X
4,521,843 6/1985 Pezzolo et al. ..... 315/360 X
4,713,586 12/1987 Chiang ..... 315/360 X

*Primary Examiner*—Eugene R. LaRoche
*Assistant Examiner*—Ali Neyzari
*Attorney, Agent, or Firm*—Rockey and Rifkin

[57] ABSTRACT

A lighting control system for pinball games employs a lighting circuit board that supports at least one string of lamps connected in parallel. The lighting board associates a triac with each lighting string for switching the output of an a.c. power supply to each lighting string. The triacs are controlled responsive to the output of a zero-cross detection circuit, which monitors the a.c. power supply. The intensity of the lighting strings is independently controllable responsive to conditions on the game playfield by varying the length of time the triac switches power relative to the zero-crossing point of the output of the a.c. power supply.

7 Claims, 2 Drawing Sheets

LIGHTING CONTROL SYSTEM FOR PINBALL GAMES

BACKGROUND AND OBJECTS OF THE INVENTION

The present invention relates to a lighting control system, and more particularly, to such a system specifically adapted for use with pinball games.

Typically, pinball game lighting is used to illuminate the playfield to allow the game player to clearly see the action on the playfield. Lighting is also used to highlight the backbox art to attract players to the game. Lighting has been used to accentuate the operation of playfield features and produce interesting visual effects. As pinball games have become more complex, improved microprocessor control of game lighting has become desirable.

It is well known in the art to employ microprocessors to control strings of bulbs connected in parallel. A microprocessor is used to turn on driver transistors to energize the lighting strings. However, this requires high power consumption and allows only simple "on-off" control of lighting strings. A more flexible means of controlling game lighting is desirable.

An improved method of lighting control employs triacs to energize lighting strings. Such a method is described in, for example, U.S. Pat. No. 3,941,926 to Slobodzian and U.S. Pat. No. 3,961,365 to Payne. These patents disclose a triac-controlled lighting system for use in energizing lighting elements on a large display system. The use of triacs reduces the power consumption. Triacs also allow enhanced controlled of lighting intensity because they can be used to supply the lighting strings with a.c. operating voltages. A zero crossing detect circuit may be used to signal the microprocessor when the a.c. voltage level crosses zero volts. The microprocessor can control the lighting intensity by delaying the firing of the triacs in relationship to the phase of the a.c. voltage. This technique is known as phase angle firing.

Although triac systems allow greater control, existing systems still fail to provide maximum flexibility in game lighting. A lighting system capable of monitoring playfield activity and adjusting the game lighting to achieve maximum player appeal while optimizing power consumption is desirable.

Accordingly, it is an object of the invention to provide a lighting control system for pinball games capable of independently adjusting the intensity of a plurality of lighting strings.

It is a further object of the invention to provide such a system having the capability of monitoring playfield conditions and adjusting the intensity of game lighting in response thereto.

It is another object of the invention to provide such a system which maximizes the useful life of lamps used in conjunction therewith.

These objects, as well as others, will become apparent to those skilled in the art from the detailed description of the invention provided below.

SUMMARY OF THE INVENTION

The lighting control system of the present invention allows enhanced control of pinball game illumination by providing independent intensity control of a plurality of lighting strings. The lighting strings are supplied with switchable power from an a.c. supply. The output of the power supply is monitored by the system, which provides an output signal when the supply voltage passes through zero volts. A triac is used to switch power to the associated lighting string for varying lengths of time relative to the zero-crossing point depending on the desired intensity level for that lighting string.

The system monitors game conditions, such as the amount of time since the game was last played, and controls the intensity of the lighting strings in response thereto. The intensity level of the lamps in each lighting string may be controlled so as to extend their life, minimizing downtime for lamp replacement.

DETAILED DESCRIPTION OF A PREFERRED EMBODIMENT

Figure 1:
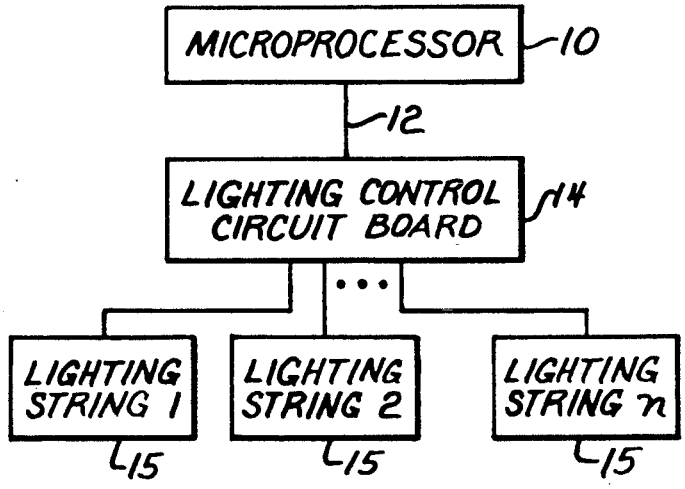
FIG. 1 is a block diagram of the lighting control system of the present invention.

Referring to the drawings, FIG. 1 shows a block diagram of the lighting control system of the present invention. A microprocessor 10 is connected by a bus 12 to a lighting control circuit board 14. The lighting board 14 controls the operation of a plurality of separate lighting strings 15, as will be described hereinafter. The lighting strings 15 may be disposed at various locations on a pinball game playfield. They may be used to accentuate the operation of specific playfield features, such as bumpers, ball ejectors or ramps, among others. Lighting strings may also be disposed in the game backbox. These strings may be controlled to emphasize the backbox artwork, improving the visual effect of the game. The actual number of lighting strings employed to illuminate the playfield and/or backbox varies from game to game; however, the use of five such strings in a given game is not uncommon.

For purposes of simplicity, the operation of the present invention will be described in terms of control of the intensity of the lighting strings by the system microprocessor 10. It will be apparent to one of ordinary skill in the art that the logic circuitry for controlling lighting intensity may be designed to operate independently of the microprocessor, with the microprocessor merely providing the circuitry with the desired level of illumination.

Figure 2:
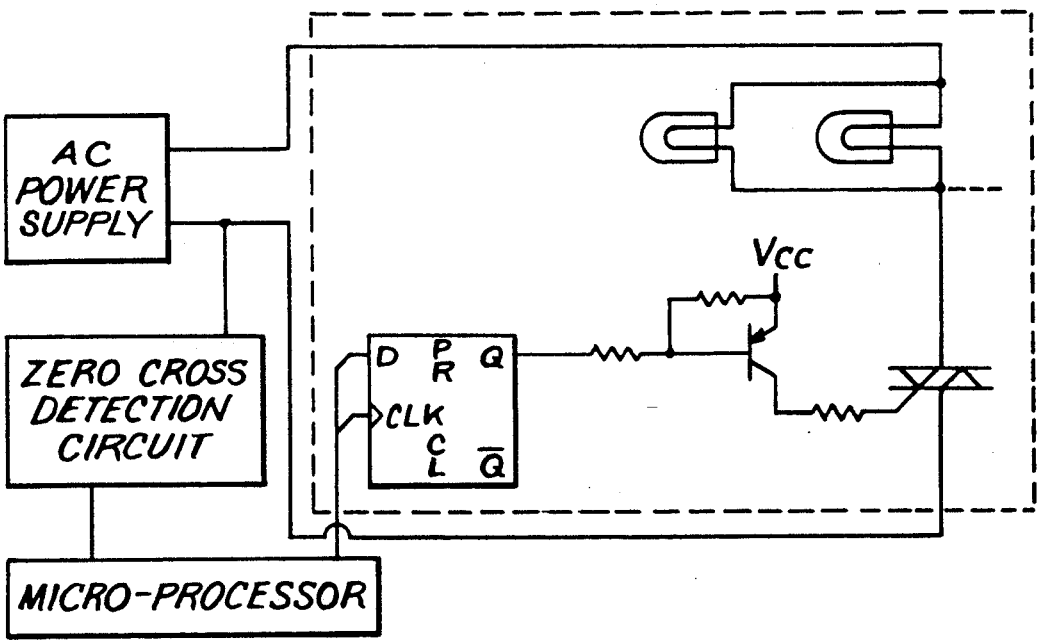
FIG. 2 is a schematic diagram of a lighting control circuit board of the present invention.

FIG. 2 shows a schematic diagram of the lighting board 14. An a.c. power supply 20 is connected to a lighting string 15, which may consist of up to 18 individual lamps connected in parallel. Power from the a.c. supply is switched to the lamps by a triac 24, which is fired by a latch 26 (a D flip-flop, for example) via a pull-up transistor 28. The lighting board 14 supports a separate triac for each lighting string 15 associated with the game. The latch 26 is connected to the microprocessor 10 by the bus 12. Upon receiving an appropriate signal from the microprocessor 10, the latch 26 turns on the pull-up transistor 28, which, in turn, fires the triac 24.

The output of the a.c. supply 20 is monitored by a zero-crossing detection circuit 30, the output of which is connected to the microprocessor 10. The microprocessor 10 is signalled when the output of the a.c. power supply 20 passes through zero volts. As will be described hereinafter, the microprocessor uses this information to control the operation of the lighting strings 15 in response to conditions on the play-field.

Figure 3:
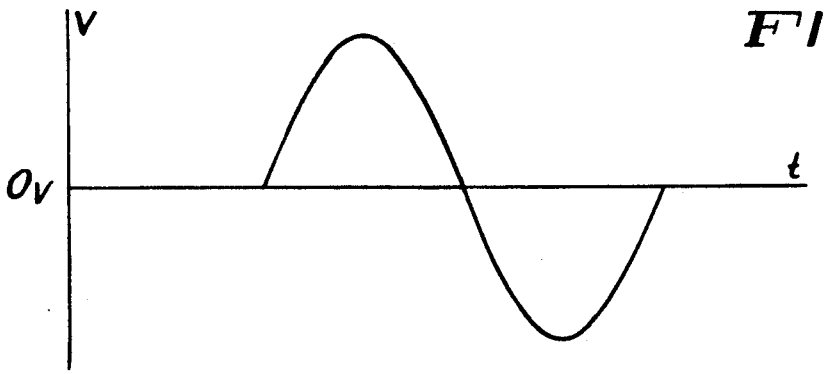
FIG. 3 is a diagram of the output voltage waveform used to supply power to the lamps of the present invention.

FIG. 3, which shows the voltage output of the a.c. power supply 20, is useful in explaining how the intensity of the lighting strings 15 is controlled. An arrow 32 shows the zero-cross point of the output waveform. As previously noted, the microprocessor 10 (or, as previously noted, other logic circuitry on the lighting board 14) is signalled by the zero-cross detection circuit 30 at this point. The triac 24 may be fired immediately or delayed until reaching any of the points identified by reference numerals 34–46 on the output waveform, depending on the desired level of illumination for a given lighting string 15.

By varying the time delay before firing the triac 24, the "on" time of the bulbs in the lighting string 15 may be controlled. As will be apparent to one of ordinary skill in the art, the intensity of the lighting string 15 is greater the sooner the triac is fired in after the zero-crossing point 32. The triac 24 shuts off when the waveform again crosses zero volts. If the triac 24 is fired at point 34, the lighting string 15 will remain on for a longer period of time than if firing occurs at point 46.

In operation, the microprocessor 10 receives a signal from the zero-cross detection circuit 30 each time the output of the a.c. power supply 20 passes through zero volts. The microprocessor determines the time delay needed to obtain the desired level of illumination. Upon expiration of the delay period, the microprocessor operates the latch 26, which turns on the pull-up transistor 28, firing the triac 24. Power is supplied to the lighting string 15 until the next zero-crossing, at which time the triac 24 ceases to conduct until being fired again upon expiration of the next delay period.

Figure 4:
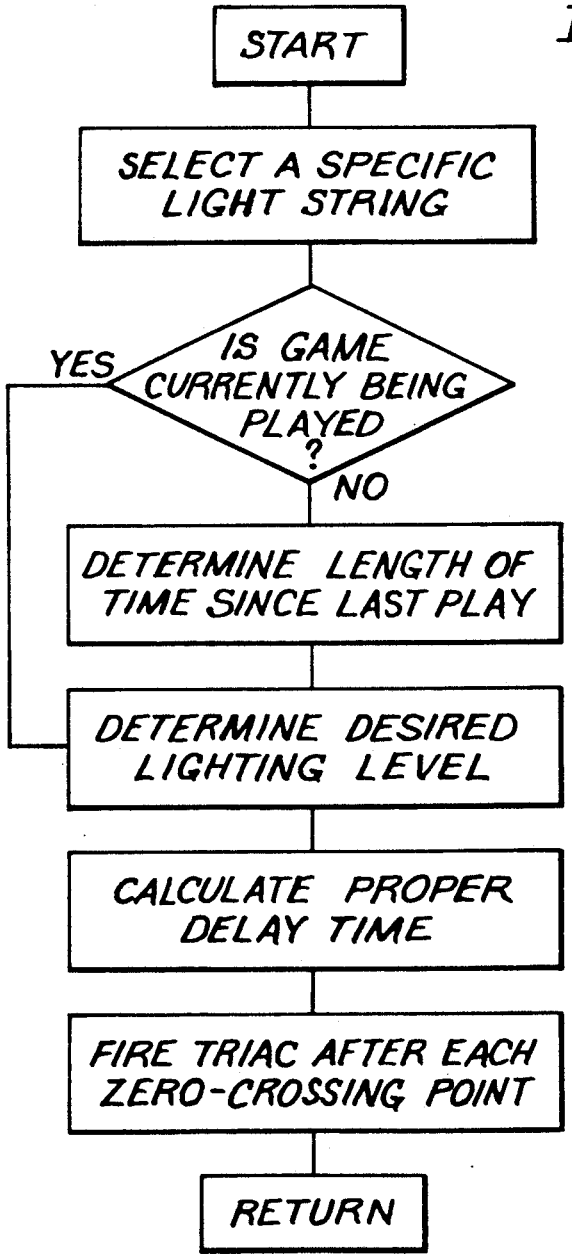
FIG. 4 is a flow diagram useful in explaining the lighting control system of the present invention.
Figure 1:
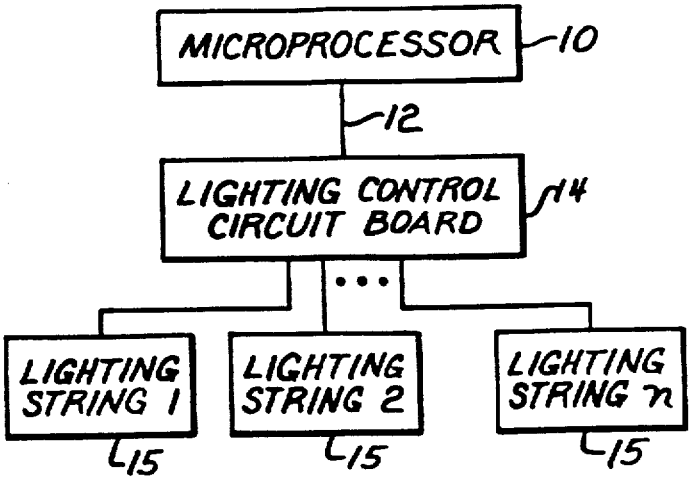
Figure 2:
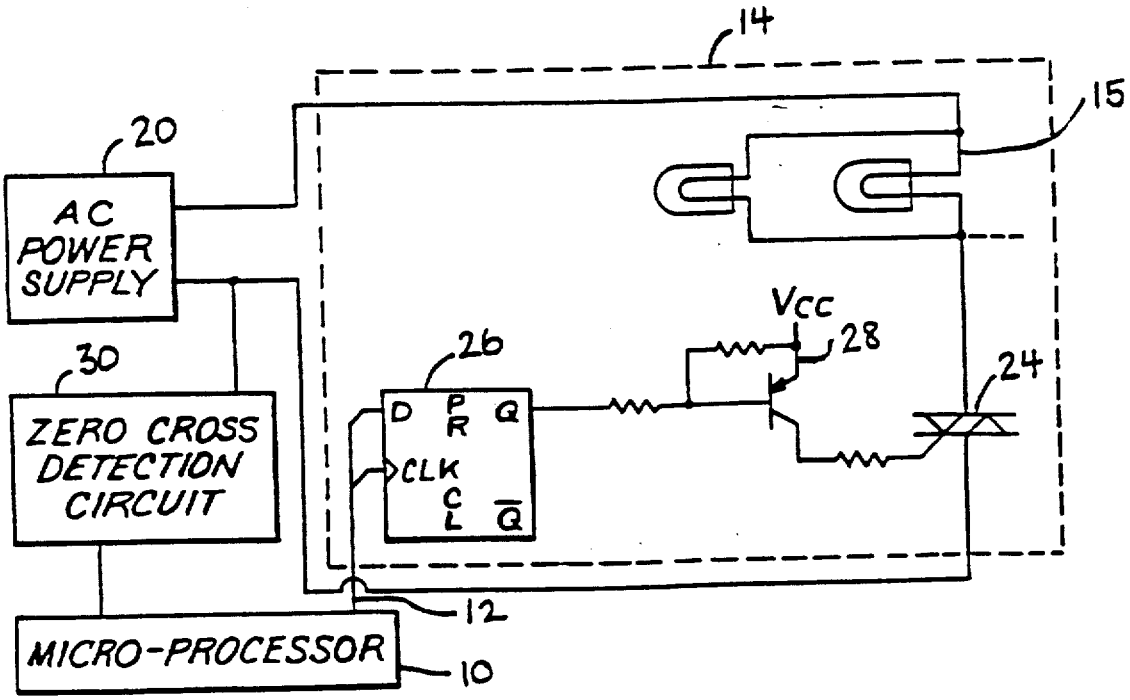
Figure 3:
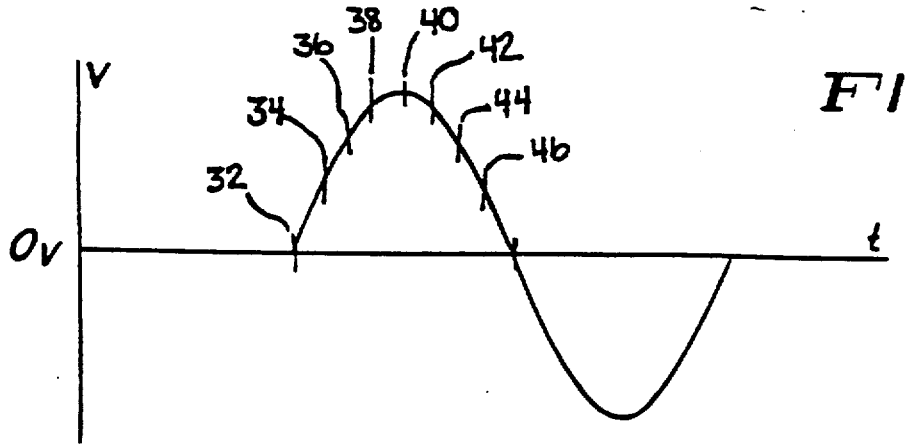
Figure 4:
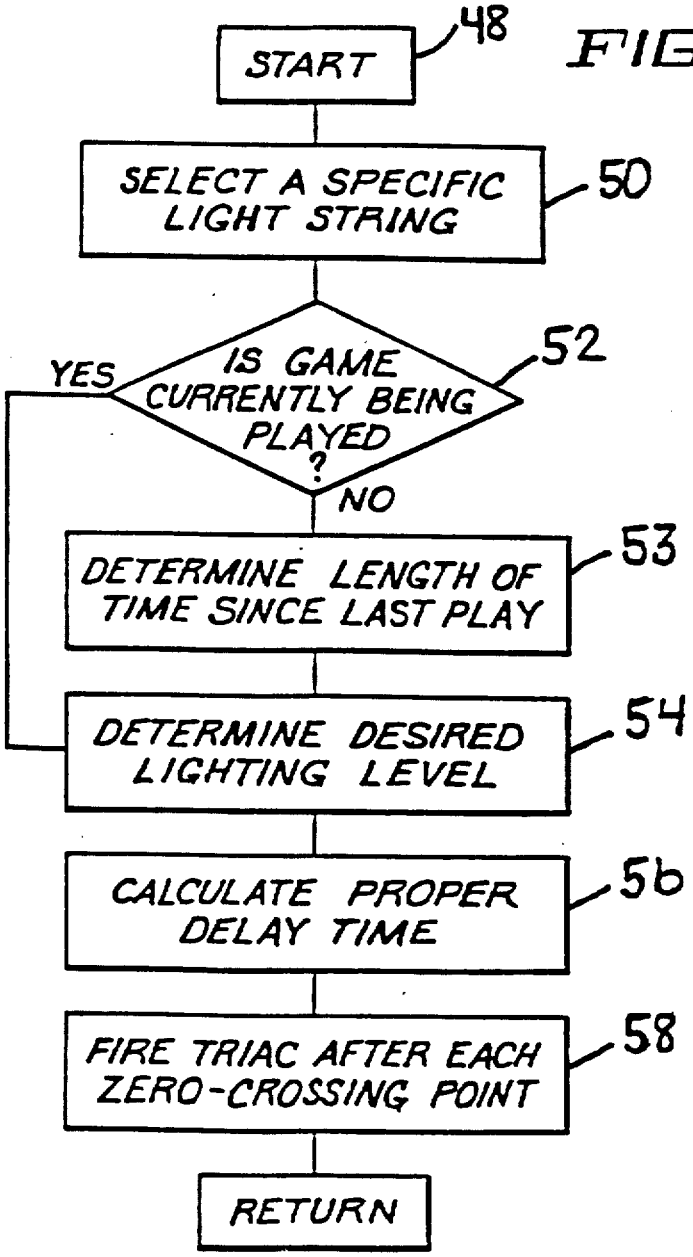

FIG. 4 is a flow diagram useful in explaining how the microprocessor determines the desired level of illumination for the lighting strings 15. The programming of the microprocessor 10 includes a routine for controlling the lighting intensity, responsive to conditions on the playfield, beginning at 48. As previously noted, the microprocessor 10 has the capability of controlling several lighting strings. The routine for adjusting lighting intensity will ordinarily be executed repetitively for each lighting board 14. Thus, at 50, the microprocessor 10 determines the next lighting board on which to perform the intensity adjustment.

At 52, the microprocessor uses information about playfield conditions stored in system memory to determine whether the game is currently being played. If the game is in use, the microprocessor next determines the lighting level desired at 54. The lighting string may be brightly lit when the game is in use, particularly when it is desirable to draw the player's attention to the area of the playfield illuminated by the lighting string being adjusted.

If the game is not presently in use, the microprocessor 10 will determine the length of time since the last play, at 53, before determining the desired lighting level. In the preferred embodiment, the programming of the microprocessor 10 causes the lamps to grow increasingly dim as the time since the game was last played increases until a predetermined minimum intensity level is reached thereby reducing the power consumption of the game during dormant periods. Thus, enhanced control of general illumination minimizes unnecessary wear on game components.

Reduction of lighting intensity has also been found to increase the life of bulbs in the lighting strings 15. Reducing the intensity from full on to about 70% increases bulb life approximately four times. The microprocessor 10 may also direct the lights to flash simultaneously or in a given sequence to direct the attention of potential players to the game.

Next, at 56, the microprocessor determines the appropriate delay time for firing the triac in relationship to the zero-cross detect signal. Finally, at 58, the triac is fired at the appropriate time.

The present invention has been described with respect to certain embodiments and conditions, which are not meant to limit the invention. Those skilled in the art will understand that variations from the embodiments and conditions described herein may be made without departing from the invention as set forth in the appended claims.

What is claimed is:

1. An interactive lighting control system for pinball games of the type having an inclined playfield and a backbox, including:

a) a lighting board having at least one lighting string including a plurality of lamps connected in parallel for illuminating said playfield or said backbox;

b) an a.c. power supply for providing power to the lighting board for energizing each associated lighting string;

c) means for detecting the zero-crossing point of said a.c. power supply and for generating a control signal when zero-crossing occurs;

d) means for switching said a.c. power to said lighting strings at selected times relative to said zero-crossing point, e) a microprocessor for receiving said control signal and for controlling said switching means to vary the length of time power is applied to said light board, said microprocessor including means for determining the duration of game inactivity and adjusting the intensity of the lighting string in response thereto.

2. The lighting control system of claim 1, wherein each lighting board includes a plurality of lighting strings, the intensity of each lighting string being independently controllable.

3. The lighting control system of claim 1 wherein the time between zero-crossing points is divided into uniform increments, the intensity of the lighting string being determined by controlling the number of said increments during which said means for switching allows power to be supplied to the lighting string.

4. The lighting control system of claim 1 wherein the intensity of the lighting string becomes increasingly dim as the time of game inactivity increases until a predetermined minimum intensity level is reached.

5. The lighting control system of claim 1 wherein the switching means includes a triac.

6. The lighting control system of claim 1 wherein the intensity of the lighting string ranges from a maximum level of full on to a minimum level of approximately 70% as the time of game inactivity increases.

7. An interactive lighting control system for pinball games of the type having an inclined playfield and a backbox, including:

a) a lighting board having at least one lighting string including a plurality of lamps connected in parallel for illuminating said playfield of said backbox;

b) an a.c. power supply for providing power to the lighting board for energizing each associated lighting string;

c) means for detecting the zero-crossing point of said a.c. power supply and for generating a control signal when zero-crossing occurs;

d) means for switching said a.c. power to said lighting strings at selected times relative to said zero-crossing point, e) a microprocessor for receiving said control signal and for controlling said switching means to vary the length of time power is applied to said light board, said microprocessor including means for determining a specific portion of the playfield or backbox to be highlighted and increasing the intensity of the lighting string associated therewith to direct attention of the game player to said specific portion.

* * * * *

UNITED STATES PATENT AND TRADEMARK OFFICE

CERTIFICATE OF CORRECTION

PATENT NO. : 5,091,677

DATED : Feb. 25, 1992

INVENTOR(S) : Charles R. Bleich, et al.

It is certified that error appears in the above-identified patent and that said Letters Patent is hereby corrected as shown below:

The title page, showing the illustrative figure, should be deleted and substitute therefor the attached title page.

Drawing Sheets 1 of 2 and 2 of 2, should be deleted and substitute therefor Drawing Sheets 1 of 2 and 2 of 2, consisting of FIGS. 1-4, as shown on the attached pages.

Signed and Sealed this

First Day of June, 1993

*Attest:*

Michael K. Kirk

MICHAEL K. KIRK

*Attesting Officer*

*Acting Commissioner of Patents and Trademarks*

US005091677A

United States Patent [19]

Bleich et al.

[11] Patent Number: 5,091,677

[45] Date of Patent: Feb. 25, 1992

[54] LIGHTING CONTROL SYSTEM FOR PINBALL GAMES

[75] Inventors: Charles R. Bleich; Mark Coldebella; Lawrence E. DeMar, all of Chicago, Ill.

[73] Assignee: Williams Electronics Games, Inc., Chicago, Ill.

[21] Appl. No.: 653,305

[22] Filed: Feb. 11, 1991

[51] Int. Cl.[5] ..... H05B 41/36

[52] U.S. Cl. ..... 315/360; 315/315; 315/307; 315/362; 307/141; 362/811

[58] Field of Search ..... 315/360, 185 S, 323, 315/209 R, 200 A, 186, 315, 307, 362; 362/806, 811; 323/238, 271, 321; 307/141.4, 139, 141

[56] References Cited

U.S. PATENT DOCUMENTS 3,941,926 3/1976 Slobodzian ..... 340/335 X
3,961,365 6/1976 Payne ..... 340/335 X
4,521,843 6/1985 Pezzolo et al. ..... 315/360 X
4,713,586 12/1987 Chiang ..... 315/360 X

*Primary Examiner*—Eugene R. LaRoche
*Assistant Examiner*—Ali Neyzari
*Attorney, Agent, or Firm*—Rockey and Rifkin

[57] ABSTRACT

A lighting control system for pinball games employs a lighting circuit board that supports at least one string of lamps connected in parallel. The lighting board associates a triac with each lighting string for switching the output of an a.c. power supply to each lighting string. The triacs are controlled responsive to the output of a zero-cross detection circuit, which monitors the a.c. power supply. The intensity of the lighting strings is independently controllable responsive to conditions on the game playfield by varying the length of time the triac switches power relative to the zero-crossing point of the output of the a.c. power supply.

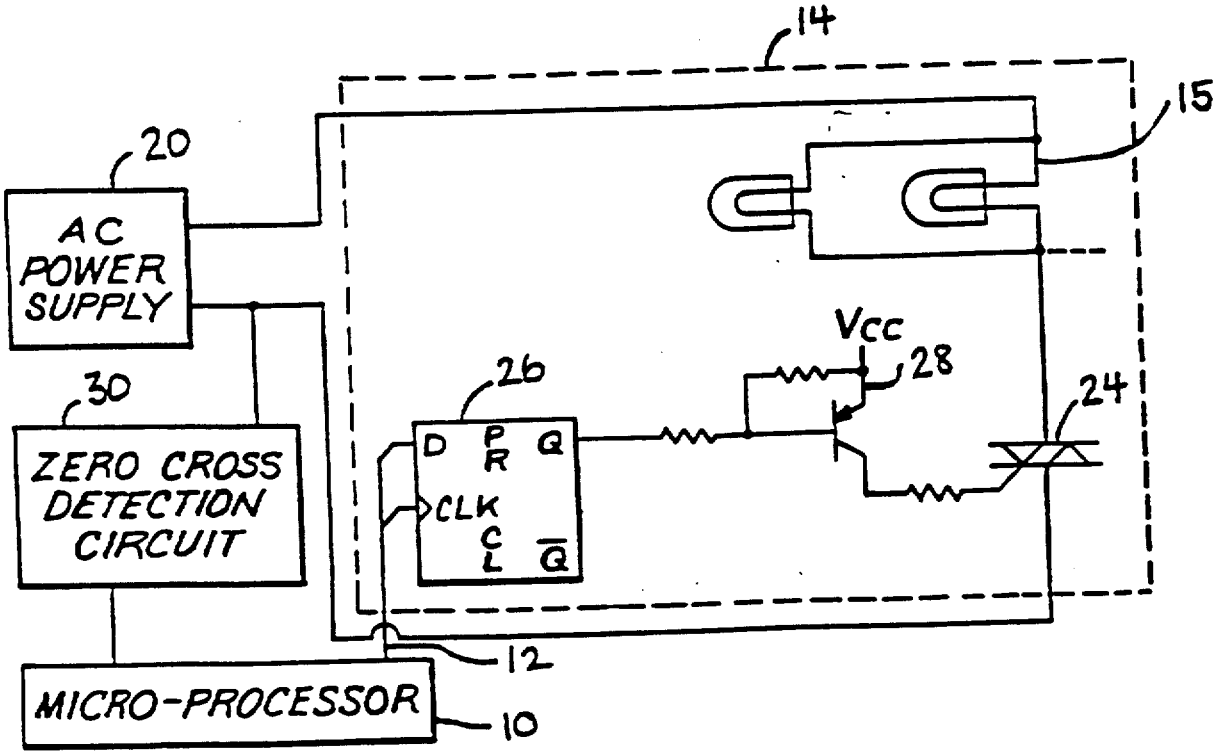

7 Claims, 2 Drawing Sheets